US011780710B1

(12) United States Patent
Darnley, III et al.

(10) Patent No.: US 11,780,710 B1
(45) Date of Patent: Oct. 10, 2023

(54) ELEVATOR DOOR INTERLOCK ASSEMBLY

(71) Applicant: Atlas Elevator Components, Inc., North Tonawanda, NY (US)

(72) Inventors: Andrew Darnley, III, Fayetteville, NY (US); Susan M. Siegmann, North Tonawanda, NY (US); Joseph H. Marshall, Auburn, NY (US); Jesse S. Duncan, Liverpool, NY (US)

(73) Assignee: Atlas Elevator Components, Inc., North Tonawanda, NY (US)

( * ) Notice: Subject to any disclaimer, the term of this patent is extended or adjusted under 35 U.S.C. 154(b) by 0 days.

(21) Appl. No.: 18/189,593

(22) Filed: Mar. 24, 2023

Related U.S. Application Data

(60) Provisional application No. 63/324,166, filed on Mar. 28, 2022.

(51) Int. Cl.
*B66B 13/22* (2006.01)
*B66B 13/04* (2006.01)

(52) U.S. Cl.
CPC ..... *B66B 13/22* (2013.01); *B66B 13/04* (2013.01)

(58) Field of Classification Search
CPC ..... B66B 13/04
See application file for complete search history.

(56) References Cited

U.S. PATENT DOCUMENTS 1,731,349 A * 10/1929 Petersen ..... B66B 13/04 187/331
6,659,514 B2 * 12/2003 Bass ..... E05B 47/0002 292/201

FOREIGN PATENT DOCUMENTS

CN 108861984 A * 11/2018 ..... B66B 13/04
CN 110127498 A * 8/2019 ..... B66B 13/04
FR 1110101 A * 2/1956
FR 2899620 A1 * 10/2007 ..... B66B 13/04
KR 200381759 Y1 * 4/2005
WO WO-2018114552 A1 * 6/2018

OTHER PUBLICATIONS

The American Society of Mechanical Engineers, Safety Code for Elevators and Escalators, ASME 17.1-2016/CSA B44-16, Revision of ASME 17.1-2013/CSA B44-13, Section 5.3.1.7.2, pg No. 187, Date of Issuance: Nov. 30, 2016, US, chrome-extension://efaidnbmnnnibpcajpcglclefindmkaj/https://docs.wixstatic.com/ugd/e90d6b_b771d06ad24f4603a8120900a8d553c2.pdf?index=true.

* cited by examiner

*Primary Examiner* — Diem M Tran
(74) *Attorney, Agent, or Firm* — C. Fred Charpie, III; Ward Law Office LLC

(57) ABSTRACT

A novel elevator door interlock assembly configured for use in an elevator having a swing door is provided. The elevator door interlock further configured to enable use of the elevator and disable use of the elevator. The novel elevator door interlock including a mounting plate configured for attachment to a surface of a swing door frame. An interlock module is attached to the mounting plate and configured to facilitate locking and unlocking of the swing door. A latch bracket is attached to the swing door and configured for insertion into a cavity formed within the interlock module. The combination of the mounting plate and the interlock module have a maximum thickness of 0.75 inches.

14 Claims, 10 Drawing Sheets

ELEVATOR DOOR INTERLOCK ASSEMBLY

RELATED APPLICATIONS

This application claims the benefit of U.S. Provisional Application No. 63/324,166 filed on Mar. 28, 2022. The entire disclosure of the above application is incorporated herein by reference in its entirety.

FIELD

The present disclosure relates generally to vertical transportation systems, more particularly, to a type of vertical transportation used in residential applications with entrances having swing doors.

INTRODUCTION

This section provides background information related to the present disclosure which is not necessarily prior art.

An elevator is a type of vertical transportation equipment that efficiently moves people and/or goods between floors, levels and/or decks of a building, vessel or other structure.

Typically, the elevator includes an elevator car configured to move in a vertical direction as guided by opposing car guide rails disposed in an elevator hoistway. In certain instances, the elevator car is supported at one end of one or more suspension ropes, which are moved with an elevator machine. The other end of the one or more suspension ropes is connected to a counterweight assembly. In other instances, the elevator car is supported by an extendable hydraulic cylinder.

The elevator hoistway is divided vertically into building floors, each having entrances configured to facilitate ingress into and egress out of the elevator car. In certain instances, the entrances typically include one or more elevator car doors and one or more hoistway doors. In other instances, such as for example residential elevators, the entrances can include a hoistway door having the form of a swing door.

A swing door is typically a manually operated door that rotates in a manner similar to a swing door that can be commonly found in a residence. In most instances, the elevator will not function until the door has been closed thereby activating a door interlock, which signals when the door is fully closed.

It would be advantageous if interlocks for elevators having swing doors could be improved.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the elevator door interlock assembly.

The above objects as well as other objects not specifically enumerated are achieved by a novel elevator door interlock assembly configured for use in an elevator having a swing door. The elevator door interlock further configured to enable use of the elevator and disable use of the elevator. The novel elevator door interlock including a mounting plate configured for attachment to a surface of a swing door frame. An interlock module is attached to the mounting plate and configured to facilitate locking and unlocking of the swing door. A latch bracket is attached to the swing door and configured for insertion into a cavity formed within the interlock module. The combination of the mounting plate and the interlock module have a maximum thickness of 0.75 inches.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
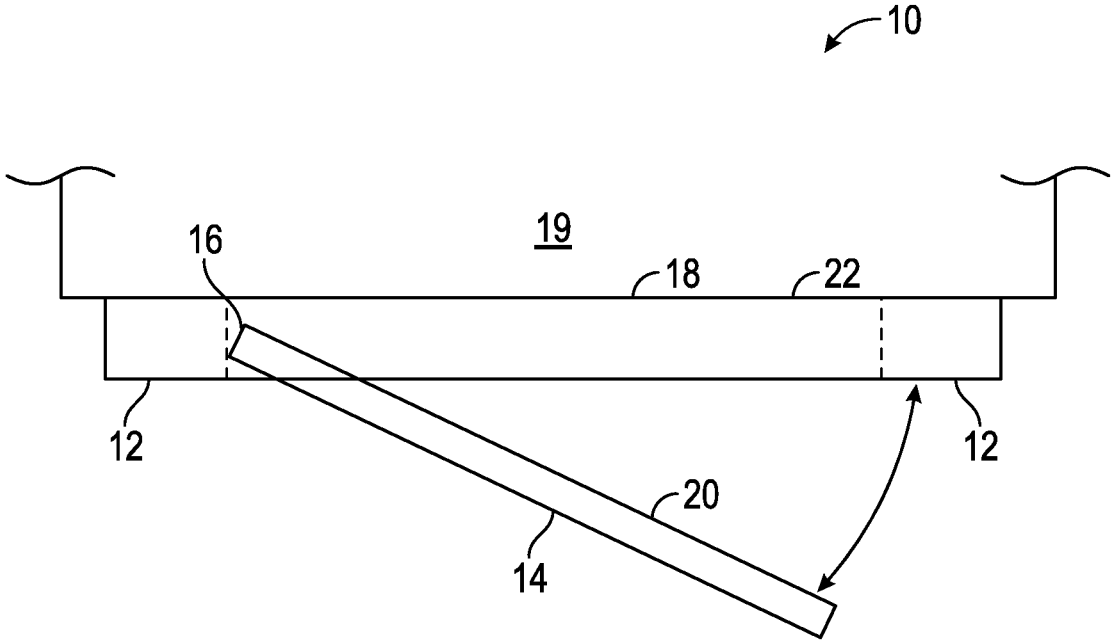
FIG. 1 is a schematic plan view of a conventional elevator entrance for a residential elevator, shown with a swing door in an open orientation.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

In accordance with embodiments of the present invention, a novel elevator door interlock assembly is provided. Generally, the novel elevator door interlock assembly is configured for positioning in a narrow space formed between the hoistway-side face of the entrance door and the hoistway-side edge of the entrance sill. This space has a maximum thickness dimension of 0.75 inches, as mandated by recent elevator code requirements, such as the non-limiting example of the 2016 ASME Al 7.1 National Safety Code for Elevators, Section 5.3.1.7.2.

Referring now to FIG. 1, a simplified, schematic illustration of a conventional entrance 10 for a residential elevator is shown. The conventional entrance includes a door frame 12, a swing door 14 supported for rotation about a first edge 16, and an entrance sill 18. The swing door 14 is shown in FIG. 1 in a rotated, open orientation. The entrance 10 abuts an elevator hoistway 19. As is known in the art, an elevator car (not shown for purposes of clarity) travels vertically within the elevator hoistway 19.

Figure 2:
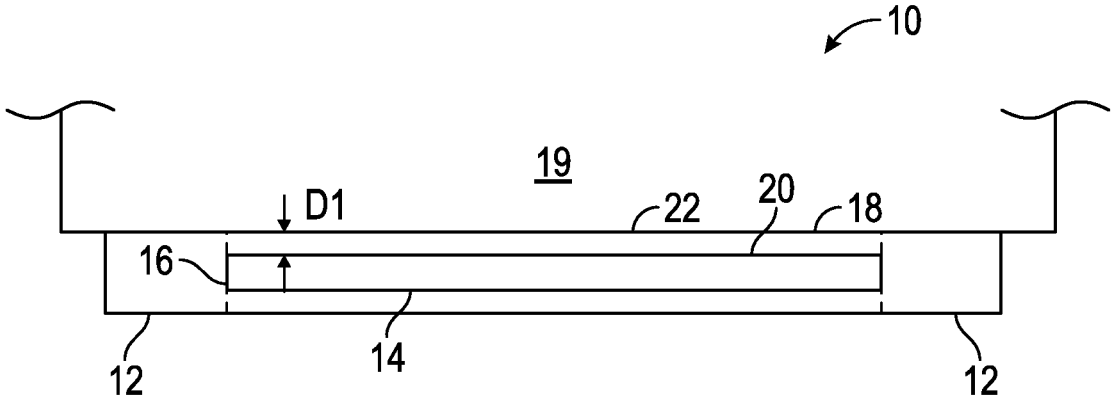
FIG. 2 is the conventional elevator entrance of FIG. 1, shown with the swing door in a closed orientation.
Figure 3:
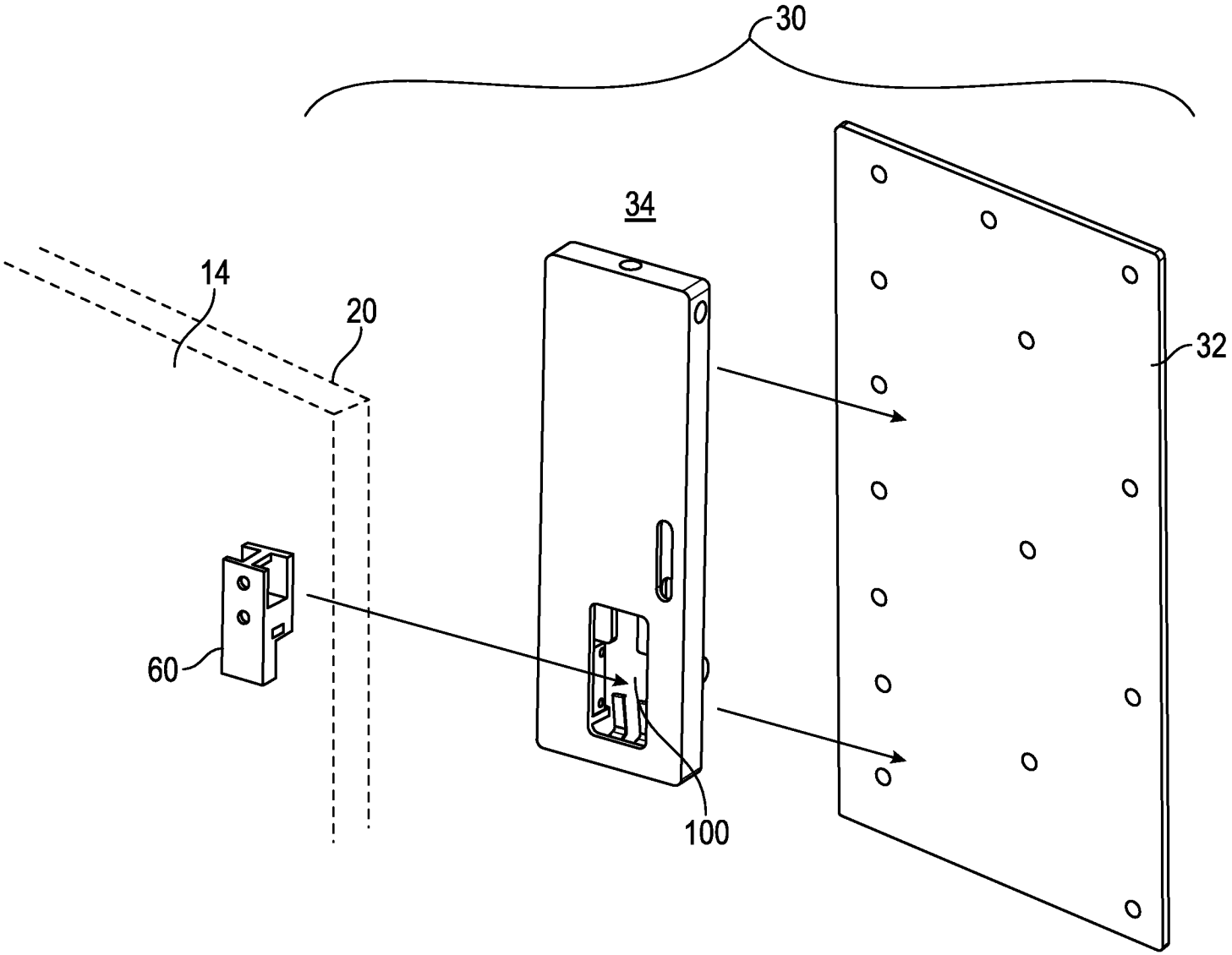
FIG. 3 is an exploded perspective view of a novel elevator door interlock assembly in accordance with the invention.

Referring now to FIG. 2, the swing door 14 is shown in a closed orientation. In the closed orientation, a hoistway-side face 20 of the swing door 14 forms a distance D1 with a hoistway side edge 22 of the entrance sill 18. In the illustrated embodiment, the distance D1 has a maximum dimension of 0.75 inches, as mandated by recent elevator code requirements, such as the non-limiting example of the 2016 ASME A17.1 National Safety Code For Elevators, Section 5.3.1.7.2.

Referring now to FIGS. 3-6, a novel elevator door interlock assembly 30 (hereafter "interlock assembly" is illustrated. The interlock assembly 30 is configured to fit within the distance D1 formed between the hoistway-side face 30 of the door 14 and the hoistway-side edge 22 of the entrance sill 18 (shown in FIG. 2). That is, the interlock assembly 30 is configured with a maximum thickness t of 0.75 inches, thereby advantageously providing compliance with the recent elevator code requirement discussed above.

Referring again to FIGS. 3-6, the interlock assembly 30 includes a mounting plate 32, an interlock module 34 and a latch bracket 60. The mounting plate 32 is configured for attachment to a surface of the door frame 12 facing the elevator hoistway 19 and includes a plurality of mounting plate apertures 35. The mounting plate apertures 35 are configured to receive mounting hardware (not shown), such as the non-limiting example of threaded fasteners. The interlock module 34 is attached to the mounting plate 32 and is configured to actuate locking and unlocking of the swing door 14. The latch bracket 60 is mounted to the hoistway-side face 20 of the swing door 14. As will be explained in more detail below, the latch bracket 60 is configured for insertion into a portion of the interlock module 34.

Figure 7:
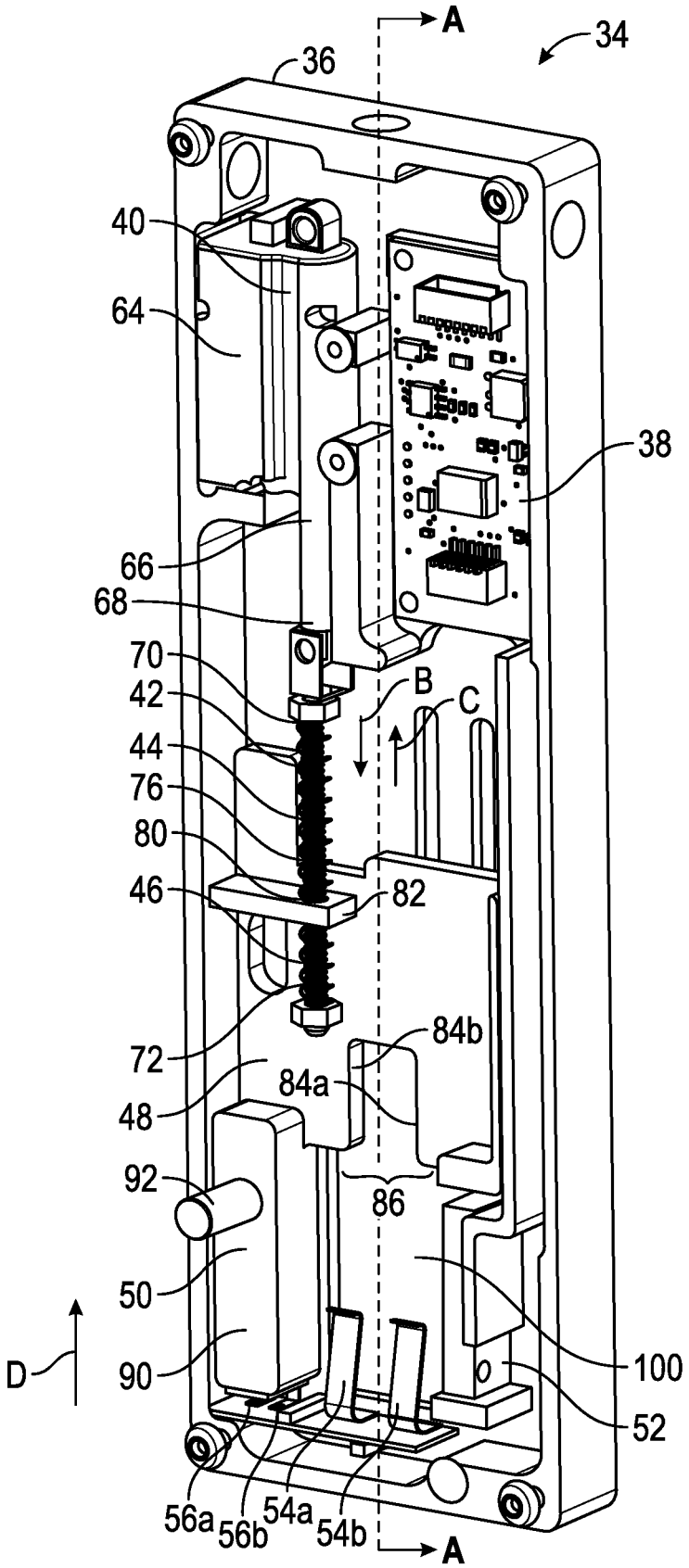
FIG. 7 is a cross-sectional perspective view of a first embodiment of an interlock module of the novel elevator door interlock assembly of FIG. 3.

Referring now to FIG. 7 a first interior views of the interlock module 34 is illustrated. The interlock module 34 includes a housing 36 configured to enclose an interlock controller 38, a linear actuator 40, a guide member 42, a first compression member 44, a second compression member 46, a latch plate 48, a release assembly 50, a proximity switch 52, one or more door closed contacts 54*a*, 54*b* and one or more door locked contacts 56*a*, 56*b*.

Referring again to FIG. 7, the interlock controller 38 is configured for several functions. First, the interlock controller 38 is configured for electrical communication with the proximity switch 52, the one or more door closed contacts 54*a*, 54*b* and the one or more door locked contacts 56*a*, 56*b*. Second, the interlock controller 38 is configured for electrical communication with an elevator controller (not shown for purposes of clarity). In the instance where the swing door 14 is in a closed and locked arrangement as detected by the proximity switch 52, the one or more door closed contacts 54*a*, 54*b* and the one or more door locked contacts 56*a*, 56*b*, the interlock controller 38 are configured to send electrical communication to the elevator controller that the swing door 14 is in a proper closed and locked position to allow the elevator car to travel within the elevator hoistway. In the instance where the swing door 14 is open, as detected by the proximity switch 52, the one or more door closed contacts 54*a*, 54*b* and the one or more door locked contacts 56*a*, 56*b*, the interlock controller 38 are configured to prevent operation of the elevator car by not signaling to the elevator controller that the swing door 14 is in a proper closed and locked position. Third, the interlock controller 38 is configured for electrical communication with the linear actuator in a manner such as to control the operation of the linear actuator 40, as will be explained in more detail below.

Referring again to the embodiment shown in FIG. 7, the interlock controller 38 has the form of a printed circuit board containing at least one microprocessor. However, it should be appreciated that in other embodiments, the interlock controller 38 can have other forms, including the non-limiting example of a miniature programmable logic controller, suitable for the functions described herein.

Referring again to FIG. 7, the linear actuator 40 is configured for electrical communication with the interlock controller 38 and is further configured to actuate axial movement of the guide member 42 from a retracted orientation to an extended orientation upon direction from the interlock controller 38. The axial movement of the guide member 66 is along the longitudinal axis A-A of the interlock module 34. The linear actuator 40 includes a main body 64 and an extending piston rod 66. The main body 64 includes an electrically operated armature (not shown) configured to axially move the piston rod 66 from the retracted orientation to the extended orientation. The axial movement of the piston rod 66 is along the longitudinal axis A-A of the interlock module 34. In the illustrated embodiment, the linear actuator 40 is electrically operated. However, in other embodiments, the linear actuator 40 can be operated in other manners as directed by the interlock controller 38, sufficient to actuate axial movement of the guide member 42 from a retracted orientation to an extended orientation upon direction from the interlock controller 38.

Referring again to FIG. 7, a distal end 68 of the piston rod 66 is coupled to a first end 70 of the guide member 42 in a manner such that axial movement of the piston rod 66 results in corresponding axial movement of the guide member 42. The axial movement of the guide member 42 is along the longitudinal axis A-A of the interlock module 34. The guide member 42 has an opposing second end 72 and an intermediate section 76 extending from the first end 70 to the second end 72. In the illustrated embodiment, the guide member 42 has the form of an elongated member having a circular cross-sectional shape, such as for example of threaded screw. However, in other embodiments, the guide member 42 can have other forms sufficient to couple to the first end 70 of the guide member 42 and move in an axial direction as caused by axial movement of the piston rod 66.

Referring again to FIG. 7, the intermediate section 76 slidably rides within an aperture 80 formed within a leg 82 extending from the latch plate 48. The first compression member 44 encircles a segment of the intermediate section 76 extending from the leg 82 to the first end 70 of the guide member 44. The second compression member 46 encircles a segment of the intermediate section 76 extending from the leg 82 to the second end 70 of the guide member 44. The first and second compression members 44, 46 are configured to control movement of the latch plate 48 as the piston rod 66 of the linear actuator 40 moves in an axial direction. In a first instance as the piston rod 66 moves from a retracted orientation to an extended orientation, as schematically depicted by direct arrow B, the first compression member 44 expands thereby urging the latch plate 48 in a same direction. In a second instance as the piston rod 66 moves from an extended orientation to a retracted orientation, as schematically depicted by direct arrow C, the second compression member 46 expands thereby urging the latch plate 48 in a same direction.

Referring again to the embodiment shown in FIG. 7, the first and second compression members 44, 46 have the form of coil springs. In alternate embodiments, it is contemplated that the first and second compression members 44, 46 can have other forms, such as the non-limiting example of leaf springs.

Figure 8:
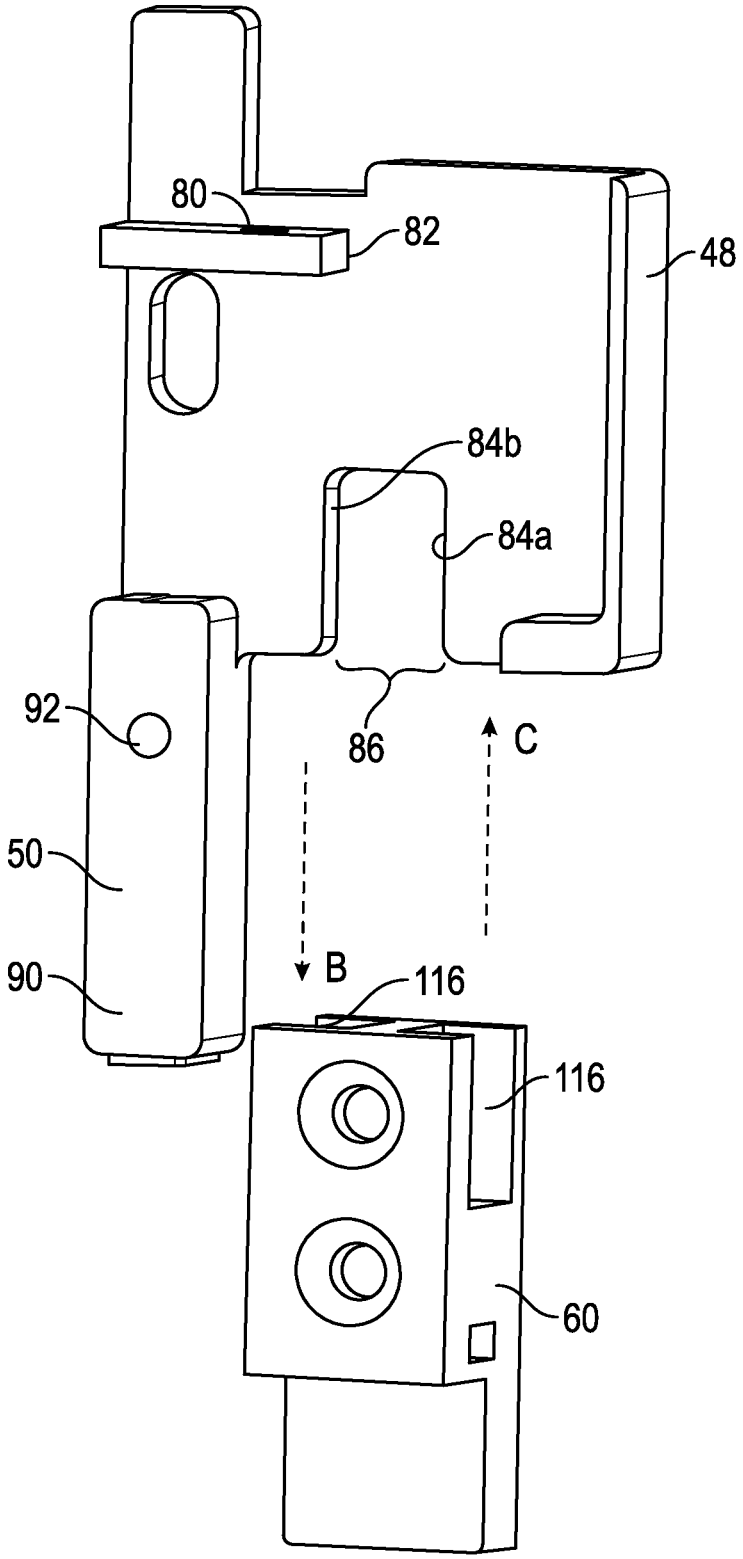
FIG. 8 is a perspective view of a latch plate and latch bracket of the novel elevator door interlock assembly of FIG. 3.

Referring now to FIGS. 7 and 8, the latch plate 48 is configured for several functions. First, the latch plate 48 is configured for a slidable connection with the guide member 42. Second, the latch plate 48 is configured for axial movement as actuated by the first and second compression members 44, 46. The axial movement of the latch plate 48 is along the longitudinal axis A-A of the interlock module 34. Third, opposing side walls 84*a*, 84*b* of a cavity 86 formed in the latch plate 48 are configured to engage portions of the latch bracket 60, as will be explained in more detail below. Finally, the latch plate 48 is configured for axial movement as caused by axial movement of the release assembly 50. The release assembly 50 will be discussed in more detail below. In the illustrated embodiment, the latch plate 48 is formed from a metallic material and has a generally planar orientation. However, in other embodiments, the latch plate 48 can be formed from other materials, such as the non-limiting example of reinforced polymeric materials and can have other orientations, sufficient for the functions described herein.

Figure 6:
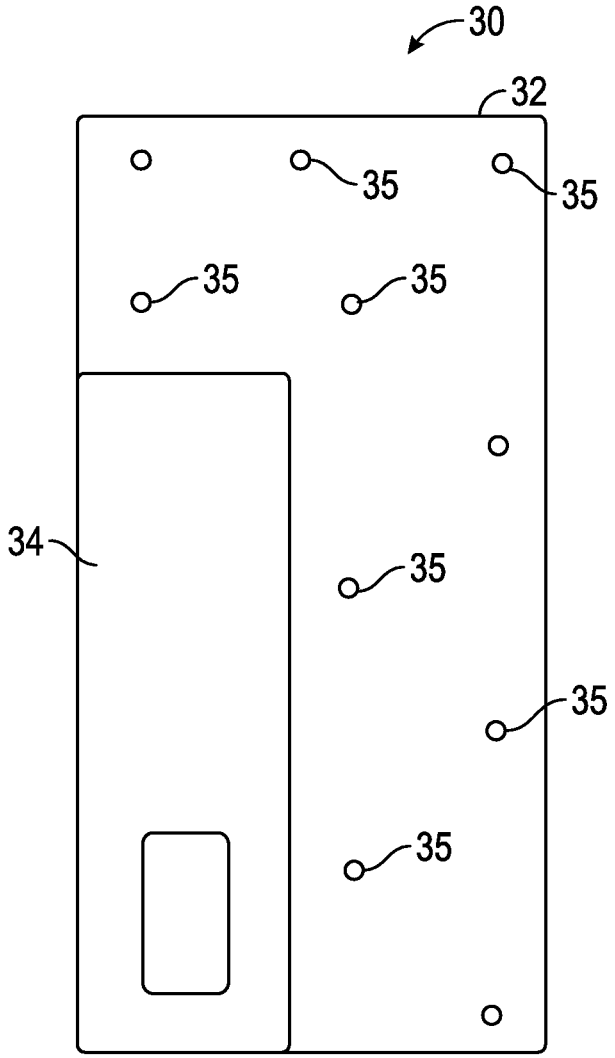
FIG. 6 is a front view of the novel elevator door interlock assembly of FIG. 3.

Referring again to FIGS. 7 and 8, the release assembly 50 is connected to the latch plate 48 and is configured to actuate manually induced axial movement of the latch plate 48. The release assembly 50 includes an extension segment 90 and a latch pin 92. The extension segment 90 extends from a lower portion of the latch plate 48 and is configured to position the latch pin 92 such that the latch pin 92 extends through an aperture 94 in the mounting plate as shown in FIG. 6. The latch pin 92 is configured for axial movement along the axis A-A. In operation as the latch pin 92 is moved in a direction toward the linear actuator 40, as shown schematically by direction arrow D, the latch plate 48 is also moved in the direction D until the side walls 84*a*, 84*b* disengage from portions of the latch bracket 60. In this manner, the interlock assembly 30 can be manually unlocked and the swing door 14 can be opened. While the release assembly 50 is described herein as having the extension segment 90 and the latch pin 92, in other embodiments, the release assembly 50 can have other structures, mechanisms and devices sufficient to manually inlock the interlock assembly 30 and permit opening of the swing door 14.

Figure 10:
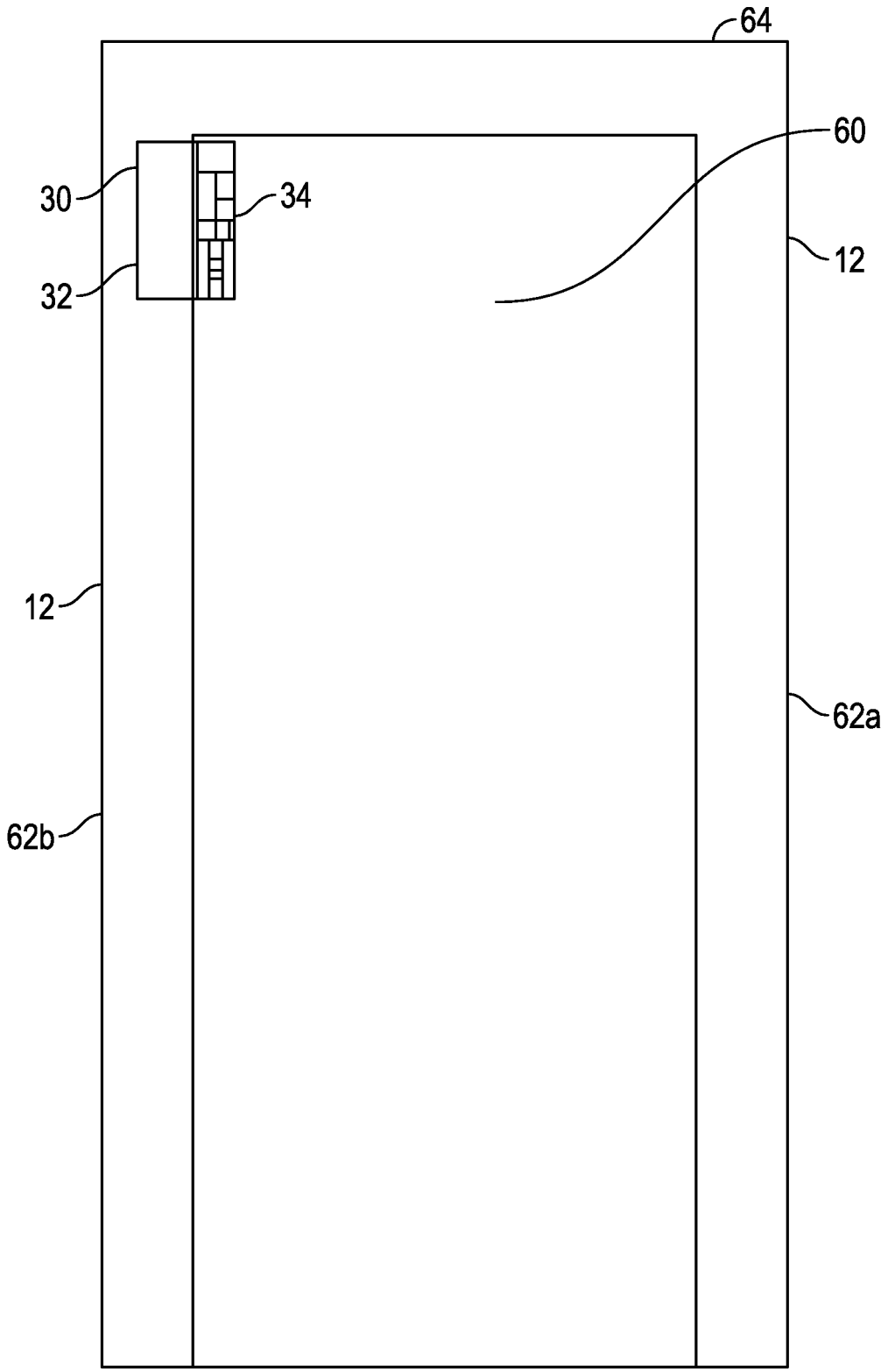
FIG. 10 is a front view of the conventional elevator entrance of FIG. 1, showing installation of the novel elevator door interlock assembly of FIG. 3.
Figure 11:
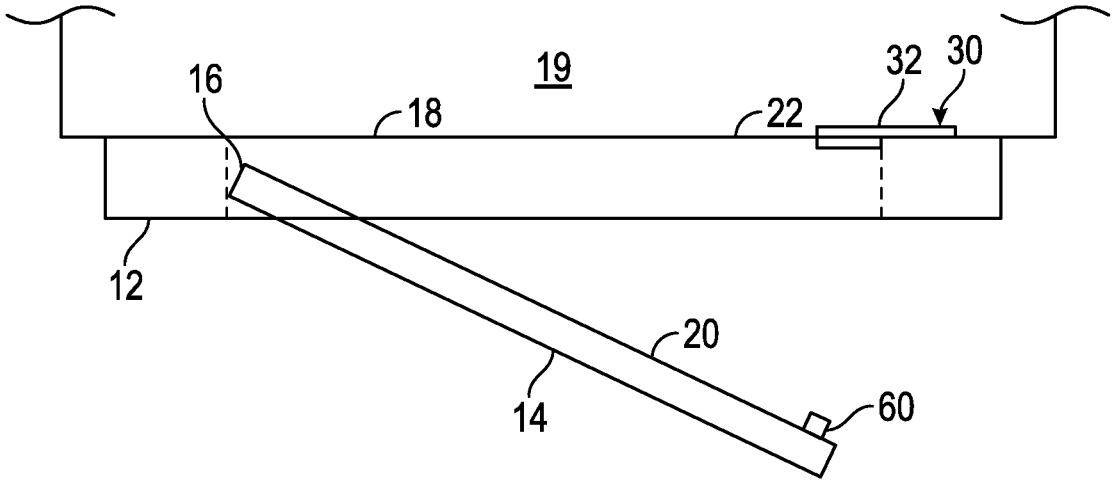
FIG. 11 is a plan view of the conventional elevator entrance of FIG. 1, showing installation of the novel elevator door interlock assembly of FIG. 3 with the swing door in an open orientation.
Figure 12:
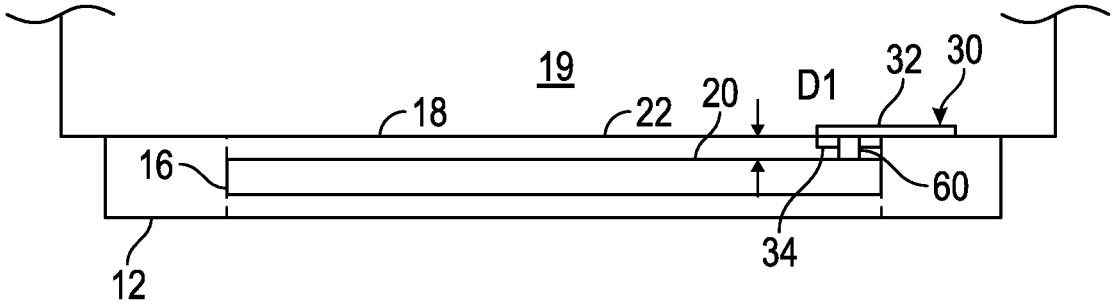
FIG. 12 is a plan view of the conventional elevator entrance of FIG. 1, showing installation of the novel elevator door interlock assembly of FIG. 3 with the swing door in an closed orientation.

Referring now to FIGS. 10-12, the novel interlock assembly 30 is shown in an installed arrangement with the door frame 12. In the installed arrangement, the mounting plate 32 of the interlock assembly 30 is attached to the surface of the door frame 12 facing the elevator hoistway 19. In the illustrated embodiment, the mounting plate 32 is attached to the surface of the door frame 12 facing the elevator hoistway 19 with a plurality of suitable fasteners, such as the non-limiting example of sheet metal screws. However, in other embodiments, the mounting plate 32 can be attached to the surface of the door frame with other suitable structures, mechanisms and devices.

Referring again to FIGS. 10-12, the interlock assembly 30 is oriented in a manner such that the interlock module 34 is positioned between the hoistway-side face 20 of the swing door 14 and the hoistway-side edge 22 of the entrance sill 18. That is, the interlock assembly 30 is positioned within the distance D1.

Figure 4:
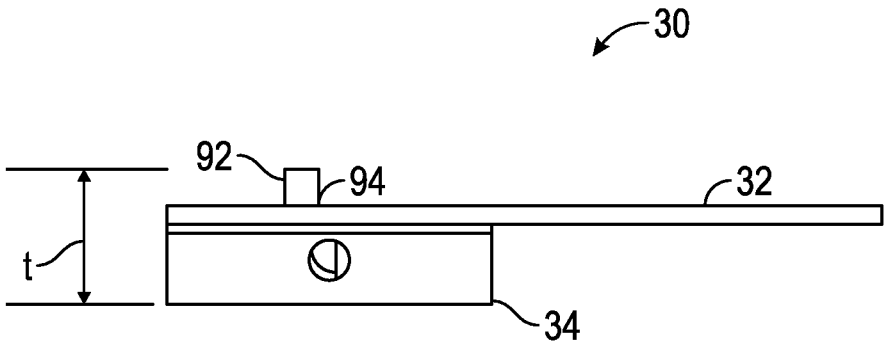
FIG. 4 is a plan view of the novel elevator door interlock assembly of FIG. 3, illustrating a thin profile.
Figure 5:
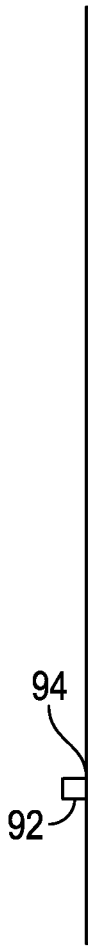
FIG. 5 is a side view of the novel elevator door interlock assembly of FIG. 3, further illustrating a thin profile.

Referring now to FIGS. 4, 11 and 12, in the installed arrangement, the thickness t of the interlock assembly 30 of a maximum of 0.75 inches advantageously allows the interlock assembly 30 to be positioned within the distance D1 of the hoistway side face 20 of the swing door 14 and the hoistway side edge 22 of the entrance sill 22.

Referring now to FIGS. 3, 8, 9 and 13, the latch bracket 60 is illustrated. The latch bracket 60 is configured for several functions. First, the latch bracket 60 is configured for attachment to the hoistway-side face 20 of the swing door 14. Second, the latch bracket 60 is configured for insertion into a cavity 100 formed within the interlock module 34. Third, the latch bracket 60 is configured to engage the one or more door closed contacts 54*a*, 54*b* and the one or more door locked contacts 56*a*, 56*b*. Finally, the latch bracket 60 is configured for sensing by the proximity switch 52.

Figure 13:
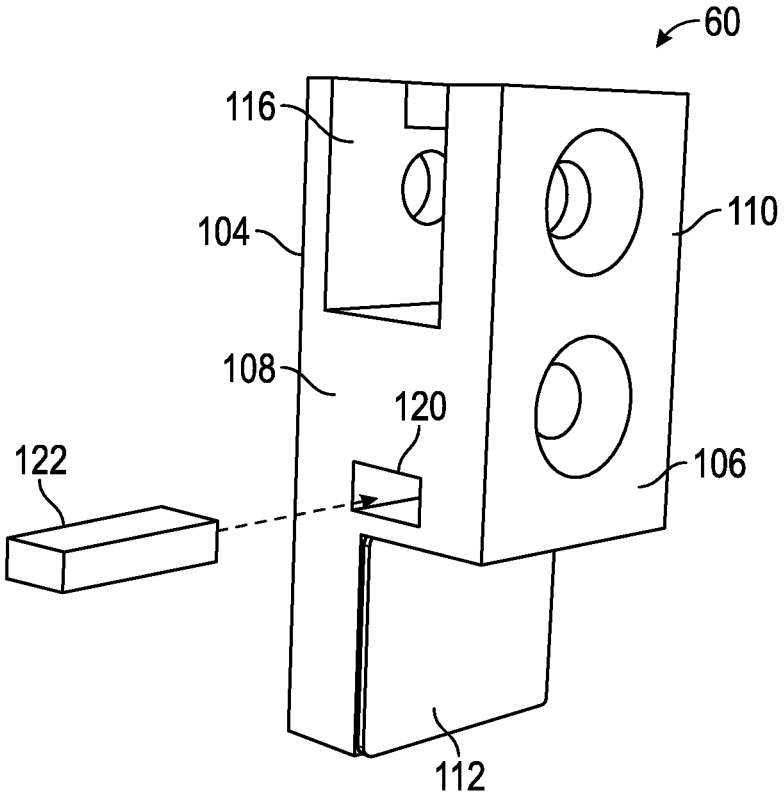
FIG. 13 is a right side perspective view of the latch bracket of FIG. 8.
Figure 14:
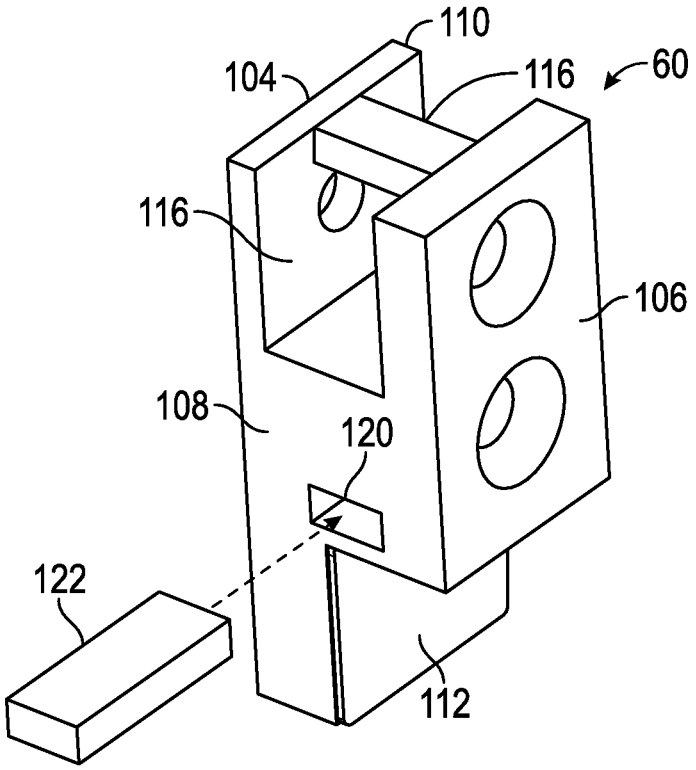
FIG. 14 is a plan perspective view of the latch bracket of FIG. 8.

Referring now to FIGS. 13 and 14, the latch bracket 60 includes a door-side face 104, an opposing outer face 106, a first side face 108 and an opposing second side face 110. The latch bracket 60 also includes a contact face 112, configured to oppose a portion of the door-side face 104. A latch bracket cavity 116 is formed between the door-side face 104 and the opposing outer face 106. As will be explained in more detail below, the latch bracket cavity 116 is configured to receive the side walls 84*a*, 84*b* of the latch plate 48. In certain embodiments, the door-side face 104 and the opposing outer face 106 can be connected together by a reinforcing segment 118. The reinforcing segment 118 is configured to strengthen the latch bracket 60 during operation, thereby preventing the swing door 14 from forceful opening. However, it should be appreciated that the reinforcing segment 118 is optional and not required for successful operation of the interlock assembly 30.

Referring again to FIGS. 13 and 14, the latch bracket 60 includes a cavity 120. The cavity 120 is configured to fixedly receive a magnet 122. In the illustrated embodiment, the cavity 120 extends from the first side face 108 to the second side face 110. However, in other embodiments, the cavity 120 need not extend from the first side face 108 to the second side face 110. In the illustrated embodiment, the cavity 120 has a rectangular cross-sectional shape that generally approximates a corresponding cross-sectional shape of the magnet 122. It is contemplated that in alternate embodiments, the cavity 120 and the magnet 122 can have different cross-sectional shapes.

Referring again to FIGS. 13 and 14, the magnet 122 is secured within the cavity 120 with the use of adhesives. However, in other embodiments, the magnet 122 can be secured within the cavity 120 with other structures, mechanisms and devices, including the non-limiting examples of clips, clamps and brackets. The magnet 122 will be discussed in more detail below.

Referring now to FIGS. 7 and 11, the operation of the interlock assembly 30 will now be described. With the swing door 14 in an open position and the latch bracket 60 attached to the hoistway-side face 60 of the swing door 14, the latch plate 48 of the interlock module 34 is in a retracted position. In the retracted position, the cavity 100 formed within the interlock module 34 is open and is ready to receive the latch bracket 60 in an unimpeded manner.

Figure 9:
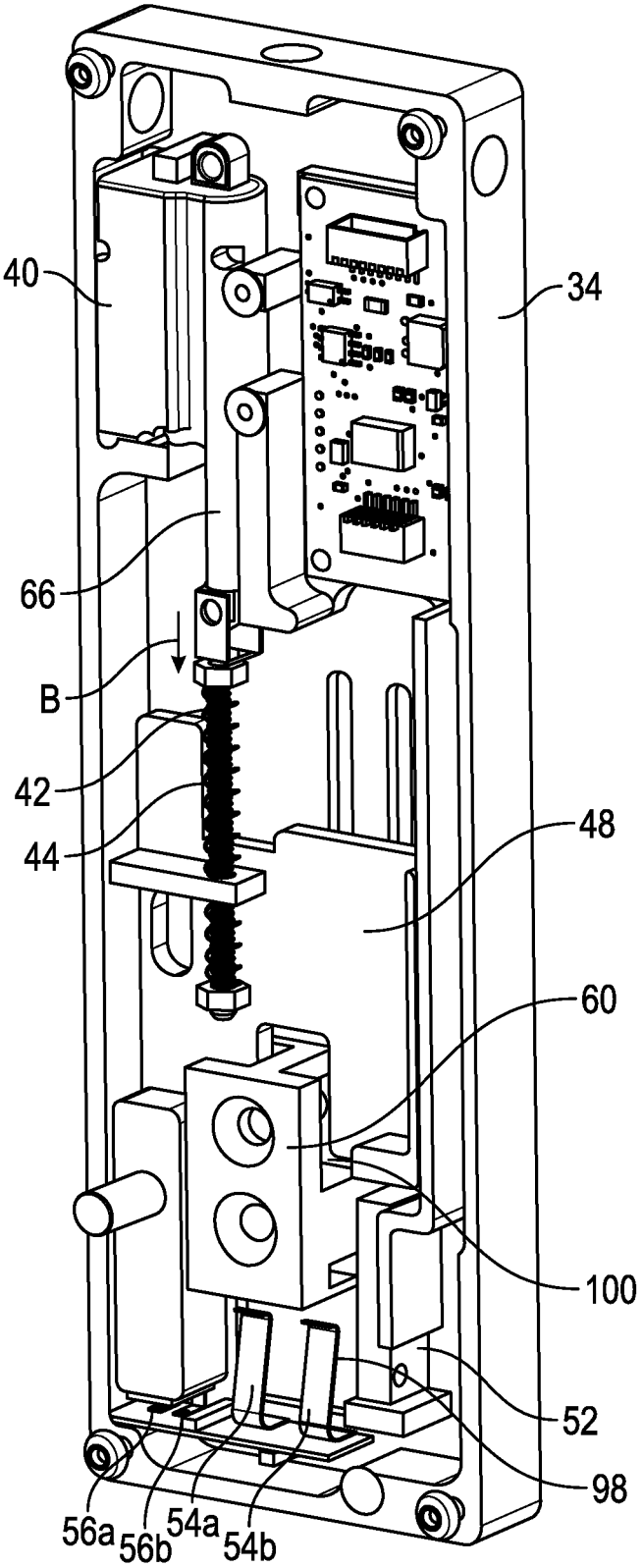
FIG. 9 is a cross-sectional perspective view of the interlock module of FIG. 7, illustrating insertion of the latch bracket of FIG. 8.

Referring now to FIGS. 9 and 12 in a next operational step, the swing door 14 is closed, thereby resulting in the insertion of the latch bracket 60 into the cavity 100 formed within the interlock module 34. In the inserted orientation, the proximity switch 52 senses the presence of the magnet 122 positioned within the cavity 120 of the latch bracket 60 and the door closed and door locked contacts 54*a*, 54*b*, 56*a*, 56*b* contact the contact face 112 of the latch bracket 60.

Referring again to FIG. 9, the proximity switch 52 is configured to sense the presence of the magnet 122 positioned within the cavity 120 of the latch bracket 60. The proximity switch 52 is further configured to electrically communicate with the interlock controller 38 that the latch bracket 60 is in place within the cavity 100. In the embodiment illustrated in FIG. 9, the proximity switch 52 has the form of a magnetic proximity switch. However, in other embodiments, the proximity switch 52 can have other forms suitable to sense the presence of the magnet 122 positioned within the cavity 120 of the latch bracket 60 and electrically communicate with the interlock controller 38 that the latch bracket 60 is in place within the cavity 100.

Referring again to FIG. 9, the one or more door closed contacts 54*a*, 54*b* are configured to engage and contact the contact face 112 of the latch bracket 60. The one or more door closed contacts 54*a*, 54*b* are further configured to electrically communicate with the interlock controller 38 that the one or more door closed contact 54*a*, 54*b* are in contact with the contact face 112 of the latch bracket 60. In the illustrated embodiment, each of the one or more door closed contacts 54*a*, 54*b* have the form of flat-bladed spring contacts. However, in alternate embodiments, each of the door closed contacts 54*a*, 54*b* can have other forms suitable to engage and contact the contact face 112 of the latch bracket 60 and electrically communicate with the interlock controller 38 such that the one or more door closed contacts 54*a*, 54*b* are in contact with the contact face 112 of the latch bracket 60.

Referring again to FIG. 9, the one or more door locked contacts 56*a*, 56*b* are configured to engage opposing contacts positioned on a lower surface of the extension segment 90 as the latch plate 48 moves in a downward direction. The one or more door locked contacts 56*a*, 56*b* are further configured to electrically communicate with the interlock controller 38 that the one or more door locked contacts 56*a*, 56*b* are in contact with the opposing contacts positioned on a lower surface of the extension segment 90. In the illustrated embodiment, each of the door locked contacts 56*a*, 56*b* has the form of a button-style contact. However, in alternate embodiments, each of the door locked contacts 56*a*, 56*b* can have other forms suitable to engage opposing contacts positioned on a lower surface of the extension segment 90 and electrically communicate with the interlock controller 38 that the one or more door locked contacts 56*a*, 56*b* are in contact with opposing contacts positioned on a lower surface of the extension segment 90.

Referring again to FIG. 9, while the embodiments of the one or more door closed contacts 54*a*, 54*b* and the one or more door locked contacts 56*a*, 56*b* are shown as having the same form, it is contemplated that in other embodiments, each of the one or more door closed contacts 54*a*, 54*b* and the door locked contacts 56*a*, 56*b* can have different forms, suitable for the functions described herein.

Referring now to FIGS. 8, 9, 11 and 12 in the next operational step, once the swing door 14 is closed, the presence of the magnet 122 positioned within the cavity 120 of the latch bracket 60 within the cavity 100 of the interlock module 34 is sensed by the proximity to the proximity switch 52. Further, the contact of the contact face 112 with the one or more door closed contacts 54*a*, 54*b* and the one or more door locked contacts 56*a*, 56*b* is sensed. In a next step, the proximity switch 52 communicates the positioning of the latch bracket 60 within the cavity 100 of the interlock module 34 to the interlock controller 38. Next, the one or more door closed contacts 54*a*, 54*b* and the one or more door locked contacts 56*a*, 56*b* communicate to the interlock controller 38 the positioning of the contacts of the latch plate 48 in contact with the one or more door closed and locked contacts 54*a*, 54*b*, 56*a*, 56*b*. The interlock controller 38 receives these communications and understands that the swing door 14 is in a closed orientation.

Referring now to FIGS. 8, 9, 11 and 12 in the next operational step, the interlock controller 38 initiates the locking process by actuating down movement of the piston rod 66, as shown schematically by direction arrow B. In a next step, downward movement of the piston rod 66 causes, in turn, corresponding downward movement of the guide member 42 and compression of the first compression member 44. Next, the compression of the first compression member 44 acts on the leg 82 to cause downward movement of the latch plate 48.

Referring now to FIG. 8, downward movement of the latch plate 48 causes insertion of the side walls 84*a*, 84*b* of the latch plate 48 into the cavity 116 of the latch bracket 60, thereby securing the latch bracket 60 in place within the interlock module 34.

Referring again to FIGS. 8, 9, 11 and 12, once the latch bracket 60 is secured in place by the latch plate 48 and the interlock controller 38 receives the communications described above from the proximity switch 52, the one or more door closed contacts 54*a*, 54*b* and the one or more door locked contacts 56*a*, 56*b* the interlock controller 38 understands that the swing door 14 is in a closed orientation. It should be understood that communication from the proximity switch 52, the one or more door closed contacts 54*a*, 54*b* and the one or more door locked contacts 56*a*, 56*b* to the interlock controller 38 must be received in order for the interlock controller 38 to communicate a 'Door Locked" signal to the elevator controller (not shown). The door locked signal is required prior to moving the elevator car within the hoistway.

Referring again to FIGS. 8, 9, 11 and 12, once the elevator car is relocated in the elevator hoistway to a desired entrance 10, the swing door 14 can be unlocked for egress of the riding passengers and ingress of new riding passengers. In an initial step of unlocking the swing door 14, the interlock assembly 34 is configured to receive electrical signals from an elevator controller. In turn, the interlock assembly 34 directs the linear actuator 40 to retract the piston 66 from the extended orientation to a retracted orientation in an axial direction, as shown schematically by direction arrow C. In a next step, upward movement of the piston rod 66 causes, in turn, corresponding upward movement of the guide member 42 and compression of the second compression member 46. Next, the compression of the second compression member 46 acts on the leg 82 to cause upward movement of the latch plate 48. The upward movement of the latch plate 48 causes the side walls 84*a*, 84*b* of the latch plate 48 to move out of the cavity 116 of the latch bracket 60, thereby releasing the latch bracket 60 from retention by the interlock module 34. Once the latch bracket is release, the swing door 14 is free for opening, as is known in the art.

As noted above, the interlock assembly 30 is configured to fit within a space having a maximum thickness of 0.75 inches, as mandated by recent elevator code requirement, such as the non-limiting example of the 2016 ASME A17.1 National Safety Code for Elevators, Section 5.3.1.7.2. Accordingly, every aspect of the interlock assembly 30 shows a focus on size and space. As non-limiting examples of the focus on size and space, the linear actuator 40, the proximity switch 52, the one or more door closed contacts 54*a*, 54*b* and the one or more door locked contacts 56*a*, 56*b* have the form of micro-sized components to limit their relative thickness. Additionally, the use of the linear actuator 40 provides a thinner profile than similarly purposed components, such as the non-limiting example of a solenoid. Further, the latch plate 48 is formed as a thin, metallic plate, thereby further limiting the thickness of the interlock module 34 and saving additional profile thickness.

Figure 15:
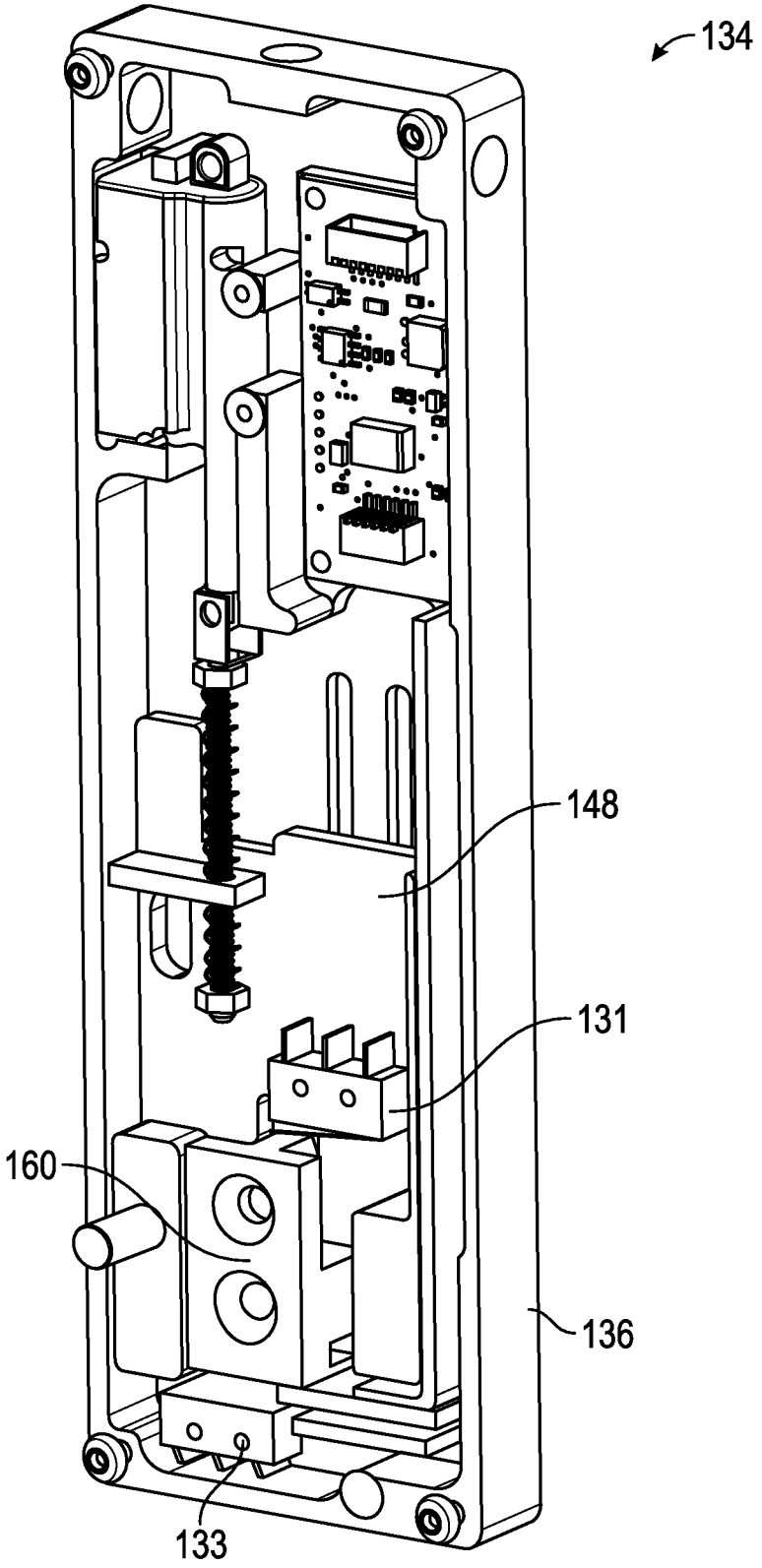
FIG. 15 is a cross-sectional perspective view of a second embodiment of an interlock module of the novel elevator door interlock assembly of FIG. 3.

While the embodiment of the interlock assembly 30 shown in FIGS. 7 and 9 illustrate the use of one or more door closed contacts 54*a*, 54*b* and the use of one or more door locked contacts 56*a*, 56*b* to sense the swing door 14 being in a closed and locked orientation, it is contemplated that in other embodiments, other structures, mechanisms and devices can be used. Referring now to FIG. 15 in a second embodiment of the interlock module 134, the one or more door closed contacts 54*a*, 54*b* are replaced with a first microswitch 131 and the one or more door locked contacts 56*a*, 56*b* are replaced with a second microswitch 133. The first microswitch 131 is connected to the latch plate 148, above the latch bracket 160, and moves as the latch plate 148 moves. As the latch plate 148 is secured to the latch bracket 160, in a manner similar as described above for latch plate 48 and latch bracket 160, the first microswitch 131 contacts the latch bracket 160 to sense the swing door 14 being in a closed and locked orientation.

Referring again to FIG. 15, the second microswitch 133 is connected to the housing 136 and is stationary as the latch plate 148 moves. As the latch plate 148 is secured to the latch bracket 160, in a manner similar as described above for latch plate 48 and latch bracket 160, the second microswitch 133 contacts a portion of the latch plate 48 to sense the swing door 14 being in a closed and locked orientation. In a manner similar to that described above, once activated the first and second microswitches 131, 133 send electrical communication to the elevator controller that the swing door 14 is in a proper closed and locked position.

As noted above, the interlock module 134 complete with the first and second microswitches 131, 133 is configured to fit within a space having a maximum thickness of 0.75 inches, as mandated by recent elevator code requirement, such as the non-limiting example of the 2016 ASME A17.1 National Safety Code for Elevators, Section 5.3.1.7.2.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A novel elevator door interlock assembly configured for use in an elevator having a swing door, the elevator door interlock further configured to enable use of the elevator and disable use of the elevator, the novel elevator door interlock comprising:

a mounting plate configured for attachment to a surface of a swing door frame; and an interlock module attached to the mounting plate and configured to facilitate locking and unlocking of the swing door, the interlock module including an interlock controller configured to electrically communicate with an elevator controller, the interlock controller further configured to electrically communicate with a linear actuator such as to actuate axial movement of a piston rod, the piston rod being coupled to a guide member in a manner such as to move as the piston rod moves, the guide member being coupled to a latch plate in a manner such as to move as the guide member moves, the latch plate including opposing side walls configured to engage a portion of the latch bracket to secure the latch bracket within the interlock module; and wherein the latch bracket is attached to the swing door and configured for insertion into a cavity formed within the interlock module;

wherein the combination of the mounting plate and the interlock module have a maximum thickness of 0.75 inches.

2. The novel elevator door interlock assembly of claim 1, wherein the mounting plate is attached to the surface of the swing door frame facing an elevator hoistway.

3. The novel elevator door interlock assembly of claim 1, wherein the interlock module is positioned in a space defined by a hoistway-side face of the swing door and a hoistway side edge of an entrance sill.

4. The novel elevator door interlock assembly of claim 1, wherein with the opposing side walls of the latch plate positioned in an extended orientation, the opposing side walls engage the latch bracket and with the opposing side walls of the latch plate positioned in a retracted orientation, the opposing side walls do not engage the latch bracket.

5. The novel elevator door interlock assembly of claim 1, wherein a proximity switch is positioned to sense the latch bracket when inserted into the interlock module.

6. The novel elevator door interlock assembly of claim 5, wherein the proximity switch is electrically coupled to the interlock module and configured to enable use of the elevator.

7. The novel elevator door interlock assembly of claim 1, wherein a door closed switch is positioned to sense the latch bracket when inserted into the interlock module.

8. The novel elevator door interlock assembly of claim 7, wherein the door closed switch is electrically coupled to the interlock module and configured to enable use of the elevator.

9. The novel elevator door interlock assembly of claim 1, wherein a door locked switch is positioned to sense the latch bracket when inserted into the interlock module.

10. The novel elevator door interlock assembly of claim 9, wherein the door locked switch is electrically coupled to the interlock module and configured to enable use of the elevator.

11. The novel elevator door interlock assembly of claim 1, wherein the latch plate includes a contact face configured to engage a door closed contact.

12. A novel elevator door interlock assembly configured for use in an elevator having a swing door, the elevator door interlock further configured to enable use of the elevator and disable use of the elevator, the novel elevator door interlock comprising:

a mounting plate configured for attachment to a surface of a swing door frame;

an interlock module attached to the mounting plate and configured to facilitate locking and unlocking of the swing door, the interlock module including an interlock controller configured to electrically communicate with an elevator controller, the interlock controller further configured to electrically communicate with a linear actuator to actuate axial movement of a piston rod, the piston rod being coupled to a guide member in a manner such as to move as the piston rod moves, the guide member being coupled to a latch plate in a manner such as to move as the guide member moves;

a latch bracket attached to the swing door and configured for insertion into a cavity formed within the interlock module; and a first compression member configured to urge a latch plate in a direction toward the latch bracket, wherein the combination of the mounting plate and the interlock module have a maximum thickness of 0.75 inches.

13. The novel elevator door interlock assembly of claim 12, wherein a second compression member is configured to urge the latch plate in a direction away from the latch bracket.

14. The novel elevator door interlock assembly of claim 12, wherein opposing side walls of the latch plate are configured for insertion into a latch bracket cavity.

* * * * *